US010134348B2

(12) United States Patent
Cote et al.

(10) Patent No.: US 10,134,348 B2
(45) Date of Patent: Nov. 20, 2018

(54) WHITE POINT CORRECTION

(71) Applicant: Apple Inc., Cupertino, CA (US)

(72) Inventors: Guy Cote, San Jose, CA (US); Mahesh B Chappalli, San Jose, CA (US)

(73) Assignee: Apple Inc., Cupertino, CA (US)

( * ) Notice: Subject to any disclaimer, the term of this patent is extended or adjusted under 35 U.S.C. 154(b) by 218 days.

(21) Appl. No.: 14/870,798

(22) Filed: Sep. 30, 2015

(65) Prior Publication Data

US 2017/0092180 A1 Mar. 30, 2017

(51) Int. Cl.
*G09G 3/36* (2006.01)
*G09G 3/3225* (2016.01)

(52) U.S. Cl.
CPC ..... *G09G 3/3648* (2013.01); *G09G 3/3225* (2013.01); *G09G 2320/029* (2013.01); *G09G 2320/0233* (2013.01); *G09G 2320/0276* (2013.01); *G09G 2320/0285* (2013.01); *G09G 2320/041* (2013.01); *G09G 2320/045* (2013.01); *G09G 2320/0666* (2013.01)

(58) Field of Classification Search
CPC ..... G09G 2320/0233; G09G 2320/0285
See application file for complete search history.

(56) References Cited

U.S. PATENT DOCUMENTS 6,704,008 B2 * 3/2004 Naito ..... G09G 3/20 345/207
6,980,219 B2 * 12/2005 Higgins ..... H04N 1/6075 345/589
7,176,861 B2 * 2/2007 Dedene ..... H01L 27/3218 345/83
7,265,766 B2 * 9/2007 Kempf ..... G09G 3/2007 345/428
7,639,849 B2 * 12/2009 Kimpe ..... G09G 3/20 345/690
7,688,297 B2 * 3/2010 Zehner ..... G02F 1/167 345/210
8,330,682 B2 12/2012 Nakamura et al.
8,482,499 B2 * 7/2013 Kimura ..... G09G 3/3611 345/87
8,575,865 B2 11/2013 Chen et al.
8,907,991 B2 * 12/2014 Jaffari ..... G06F 17/5018 345/204
9,171,508 B2 * 10/2015 Sprague ..... G09G 3/344
(Continued)

FOREIGN PATENT DOCUMENTS

WO 2013124345 A1 8/2013

*Primary Examiner* — Chad Dicke
(74) *Attorney, Agent, or Firm* — Fletcher Yoder PC

(57) ABSTRACT

A method for adjusting the gain of a plurality of pixels across a display includes determining grid point gain adjustments for a plurality of grid points corresponding to coordinates across the display. The corresponding coordinates have a non-uniform spacing across the display. The method also includes determining uniformity gain adjustments for the plurality of pixels via interpolation with the grid point gain adjustments. The method also includes multiplying the uniformity gain adjustment for each pixel of the plurality of pixels by an input signal to the respective pixel. The drive strength supplied to the respective pixel is based at least in part on the input signal, and the drive strength supplied to each pixel is configured to control the light emitted from the respective pixel.

19 Claims, 13 Drawing Sheets

(56) References Cited

U.S. PATENT DOCUMENTS 9,513,169 B2 * 12/2016 Ohnishi ..... G01J 3/46
2003/0137521 A1 * 7/2003 Zehner ..... G02F 1/167 345/589
2003/0231158 A1 * 12/2003 Someya ..... G09G 3/3611 345/101
2004/0113906 A1 * 6/2004 Lew ..... G09G 3/3406 345/211
2004/0196234 A1 * 10/2004 Shiomi ..... G09G 3/3648 345/89
2005/0007392 A1 * 1/2005 Kasai ..... G09G 3/2014 345/690
2005/0206645 A1 * 9/2005 Hancock ..... G09G 5/06 345/501
2006/0061593 A1 * 3/2006 Miura ..... G09G 3/22 345/612
2006/0262147 A1 * 11/2006 Kimpe ..... G09G 3/20 345/690
2007/0103411 A1 * 5/2007 Cok ..... G09G 3/3216 345/82
2008/0068293 A1 * 3/2008 Ishii ..... G09G 3/20 345/3.1
2008/0068404 A1 * 3/2008 Ishii ..... G09G 3/20 345/690
2008/0166043 A1 * 7/2008 Bassi ..... G09G 3/2003 382/167
2009/0058772 A1 * 3/2009 Lee ..... G09G 3/3233 345/82
2010/0194773 A1 * 8/2010 Pan ..... G09G 5/02 345/590
2011/0025592 A1 * 2/2011 Botzas ..... G09G 3/3406 345/102
2011/0032275 A1 * 2/2011 Marcu ..... G09G 3/2003 345/690
2012/0081279 A1 * 4/2012 Greenebaum ..... G09G 5/02 345/156
2012/0139955 A1 * 6/2012 Jaffari ..... G06F 17/5018 345/690
2013/0083080 A1 * 4/2013 Rappoport ..... G09G 3/20 345/690
2013/0135272 A1 * 5/2013 Park ..... G09G 3/3233 345/211
2013/0194199 A1 * 8/2013 Lynch ..... G06F 3/0412 345/173
2013/0321674 A1 * 12/2013 Cote ..... H04N 9/64 348/242
2015/0145841 A1 * 5/2015 Lee ..... G09G 3/006 345/207
2015/0340002 A1 * 11/2015 Hu ..... G09G 3/3607 345/89
2016/0126257 A1 * 5/2016 Cao ..... G09G 3/20 257/72
2017/0025067 A1 * 1/2017 Jaffari ..... G06F 17/5018
2017/0110072 A1 * 4/2017 Matsui ..... G09G 3/3607

* cited by examiner

WHITE POINT CORRECTION

BACKGROUND

The present disclosure relates generally to imaging on electronic displays and, more particularly, to gain adjustment to control an emitted white point of an electronic display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays may be found in a variety of devices, such as computer monitors, televisions, instrument panels, mobile phones, tablet computers, and clocks. One type of electronic display, known as a liquid crystal display (LCD), displays images by modulating the amount of light allowed to pass through a liquid crystal layer within pixels of the LCD. In general, LCDs modulate the light passing through an array of pixels, with each pixel having multiple colors (e.g., subpixels). Primary colors of light, (e.g., red, green, and blue) may be combined in each pixel to create many other colors, including white. Some displays, such as organic light emitting diode (OLED) displays, display images by modulating light emitted from an array of pixels, with each pixel having multiple colors (e.g., subpixels). Controllers drive an array of pixels and/or subpixels with coordinated instructions to create an image on the electronic display.

However, various properties affect the color and/or the brightness of the light from each pixel. For example, temperature, pixel location, the type of backlight, age of the backlight, and other factors may affect the light emitted through each pixel such that the emitted light from the electronic display may have non-uniformities if each pixel operated with the same instructions. It may be useful to provide electronic displays with gain adjustment for the subpixels to control an emitted white point of the electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Various embodiments of the present disclosure relate to methods and devices for adjusting the gain of pixels of an electronic display. By way of example, a method may include adjusting the gain of each pixel of the electronic display based on non-uniformities of the electronic display and the dynamic temperature of the display during operation. The method may adjust the gain of each pixel to align the emitted white point of light from the pixels with a target white point. The uniformity gain adjustment and the dynamic adjustment may be determined independently, then resolved together as a total adjustment to the gain for each pixel of the electronic display. Each gain adjustment process may utilize a lookup table to determine the gain adjustment at certain points of an image frame to be shown on the electronic display, then determine the gain adjustment at other points of the image frame via interpolation (e.g., bilinear interpolation). Adjusting the gain based on non-uniformities of the electronic display and the dynamic temperature of the display may improve the image quality and the appearance of the image frame on the electronic display by reducing variations across the electronic display. For example, the gain may be adjusted to reduce image non-uniformities due to edge effects, effects of a manufacturing process of the display, temperature effects, or any combination thereof.

Various refinements of the features noted above may exist in relation to various aspects of the present disclosure. Further features may also be incorporated in these various aspects as well. These refinements and additional features may exist individually or in any combination. For example, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
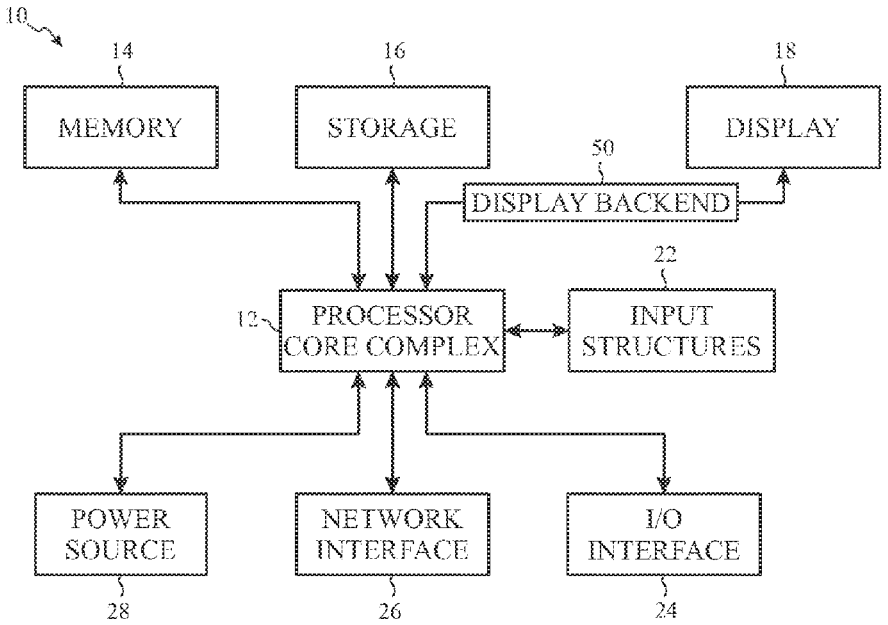
FIG. 1 is a schematic block diagram of an electronic device including a display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Various embodiments of the present disclosure relate to methods and devices for adjusting the gain of pixels of an image frame to be displayed on an electronic display. By way of example, a method may include adjusting the gain of each pixel of the image frame based on non-uniformities of the electronic display and the dynamic temperature of the display during operation. The method may adjust the gain of each pixel to align the emitted white point of light from the pixels with a target white point. A white point of a light source (e.g., backlight, pixel with subpixels) is a set of chromaticity values used to compare light sources. The white point of a light source is associated with its color and its component lights. The uniformity gain adjustment and dynamic adjustment may be determined independently, then resolved together as a total adjustment to the gain for each pixel of the electronic display. Each gain adjustment process may utilize a lookup table or computation to determine the gain adjustment at certain points of the image frame to be shown on the electronic display, then determine the gain adjustment at other points of the image frame via interpolation (e.g., bilinear interpolation). Adjusting the gain based on non-uniformities of the electronic display and the dynamic temperature of the display may improve the image quality and appearance of the image frame on the electronic display by reducing variations across the electronic display. For example, the gain may be adjusted to reduce image non-uniformities due to edge effects, effects of a manufacturing process of the display, temperature effects, or any combination thereof. As may be appreciated, a uniform image may be desired despite non-uniformities of display components, which may vary among suppliers and/or groupings (e.g., lots, shipments) of display components.

Turning first to FIG. 1, an electronic device 10 according to an embodiment of the present disclosure may include, among other things, a processor core complex 12 having one or more processor(s) or processor cores, local memory 14, a main memory storage 16, a display 18, a display backend 50, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10. Additionally, it should be noted that the various depicted components may be combined into fewer components or separated into additional components. For example, the local memory 14 and the main memory storage 16 may be included in a single component.

Figure 2:
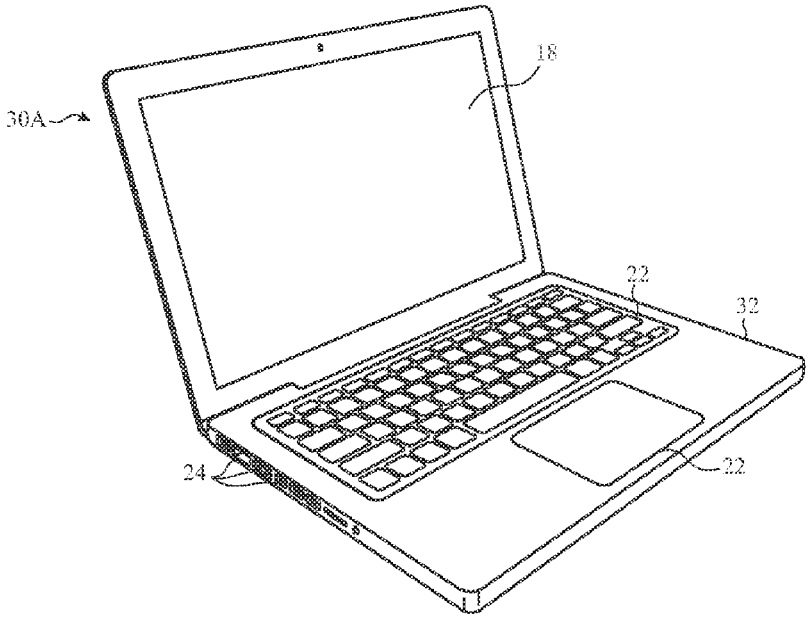
FIG. 2 is a perspective view of a notebook computer representing an embodiment of the electronic device of FIG. 1.
Figure 3:
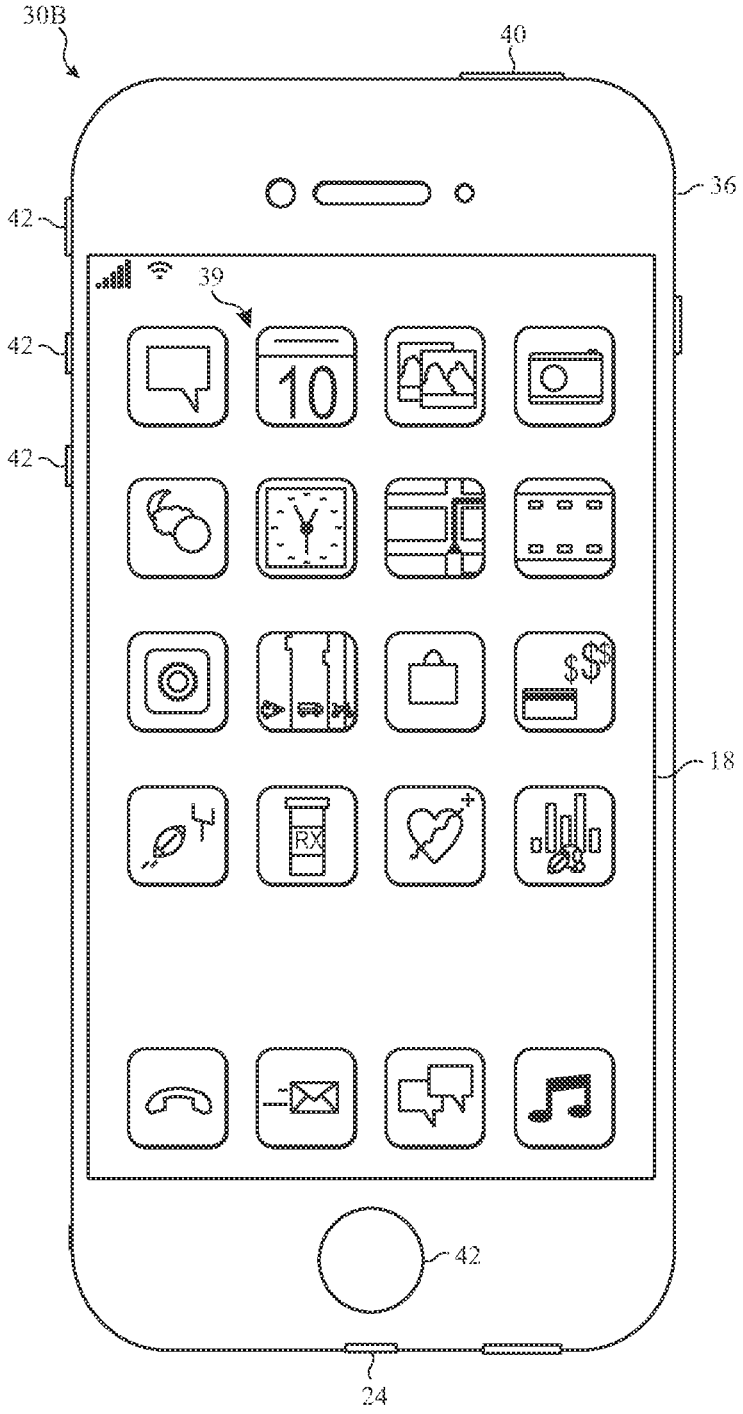
FIG. 3 is a front view of a hand-held device representing another embodiment of the electronic device of FIG. 1.
Figure 4:
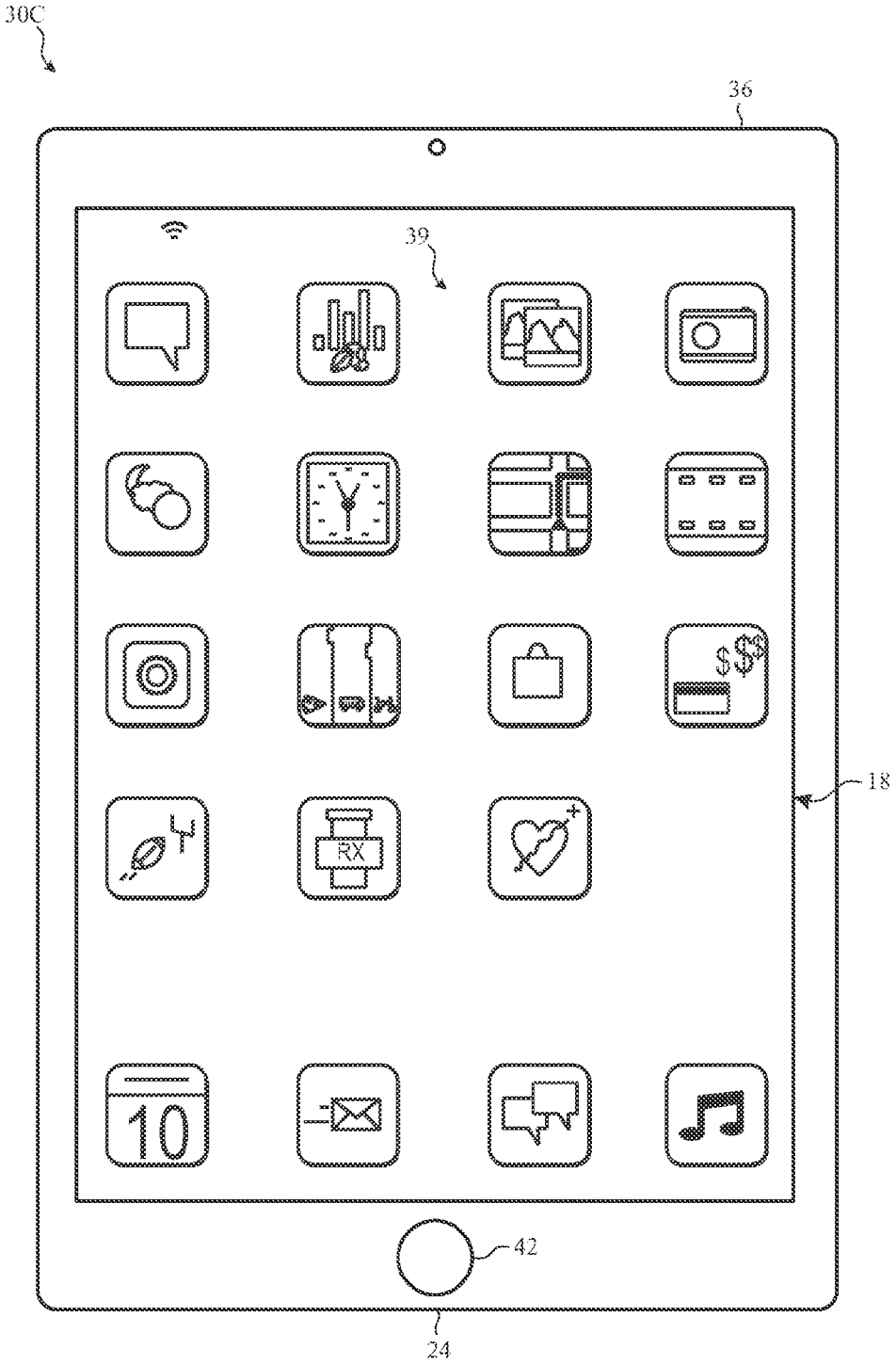
FIG. 4 is a front view of another hand-held device representing another embodiment of the electronic device of FIG. 1.
Figure 5:
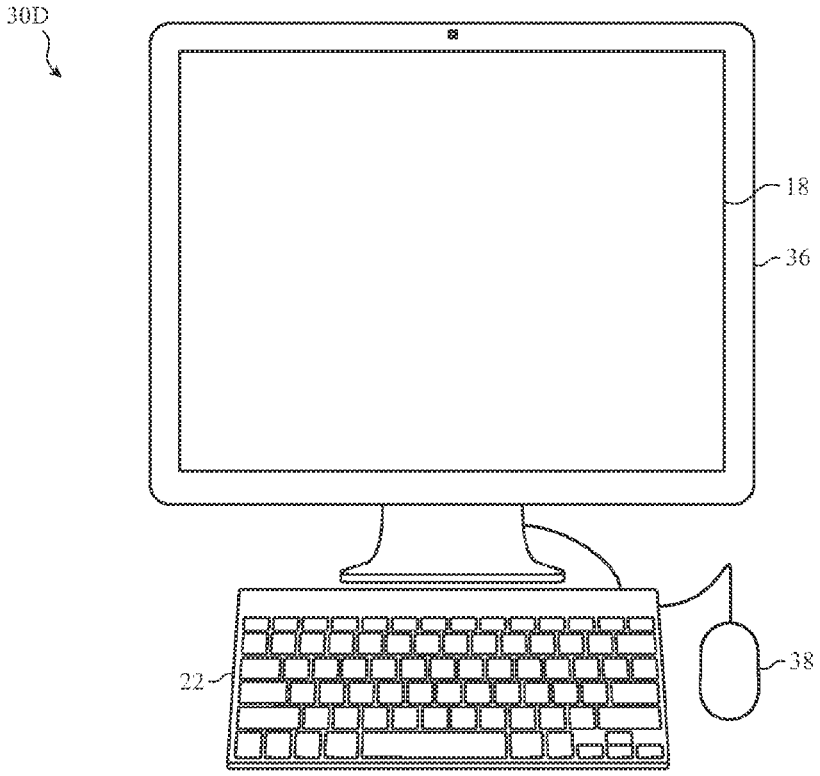
FIG. 5 is a front view of a desktop computer representing another embodiment of the electronic device of FIG. 1.

By way of example, the electronic device 10 may represent a block diagram of the notebook computer depicted in FIG. 2, the handheld device depicted in FIG. 3, the desktop computer depicted in FIG. 4, the wearable electronic device depicted in FIG. 5, or similar devices. It should be noted that the processor complex 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor complex 12 and/or other data processing circuitry may be operably coupled with the local memory 14 and the main memory 16 to perform various algorithms. Such programs or instructions executed by the processor complex 12 may be stored in any suitable article of manufacture that may include one or more tangible, computer-readable media at least collectively storing the instructions or routines, such as the local memory 14 and the main memory storage 16. The local memory 14 and the main memory storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor complex 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels. Further, in some embodiments, the display 18 may include a light source (e.g., backlight) that may be used to emit light to illuminate displayable images on the display 18. Indeed, in some embodiments, as will be further appreciated, the light source (e.g., backlight) may include any type of suitable lighting device such as, for example, cold cathode fluorescent lamps (CCFLs), hot cathode fluorescent lamps (HCFLs), and/or light emitting diodes (LEDs), or other light source that may be utilize to provide highly backlighting. The display backend 50 may process image data to prepare the image data for the electronic display 18. The display backend 50 may include dynamic and white point correction logic to adjust the gain of input signals corresponding to pixels or subpixels of the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra Wideband (UWB), alternating current (AC) power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, or may toggle between vibrate and ring modes. The input structures 42 may also include a microphone may obtain a user's voice for various voice-related features, and a speaker may enable audio playback and/or certain phone capabilities. The input structures 42 may also include a headphone input may provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Figure 6:
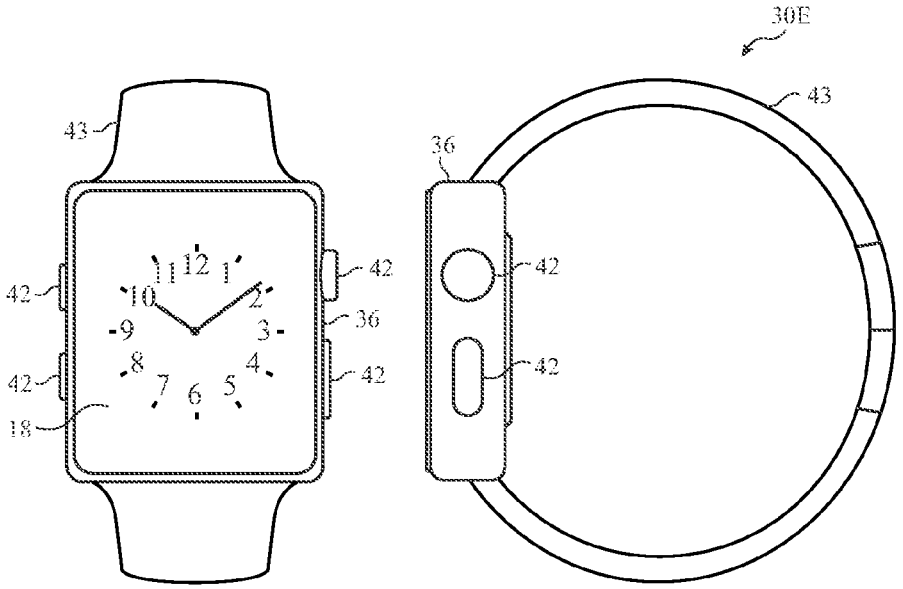
FIG. 6 is a front view of a wearable electronic device representing another embodiment of the electronic device of FIG. 1.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, OLED display, active-matrix organic light emitting diode (AMOLED) display, and so forth), which may allow users to interact with a user interface of the wearable electronic device 30E.

Figure 7:
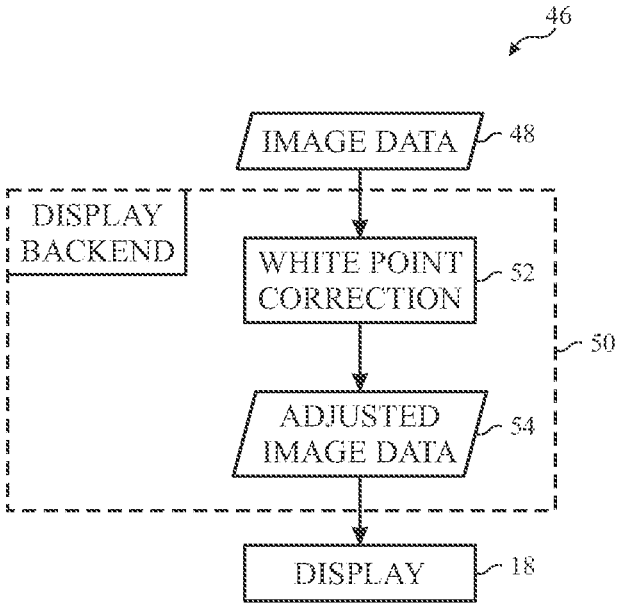
FIG. 7 is a block diagram of an embodiment of processing image data to produce an image frame on a display of the electronic device of FIG. 1.

In certain embodiments, as previously noted above, each embodiment (e.g., notebook computer 30A, handheld device 30B, handheld device 30C, computer 30D, and wearable electronic device 30E) of the electronic device 10 may include a display 18. As discussed in detail below, circuitry of the display 18 may produce user viewable images of an image frame on the display 18 based on image data. The image data may be adjusted based on properties of the display 18 to affect the appearance of the image frame on the display 18. FIG. 7 illustrates a block diagram 46 for the processing of image data 48 to produce the image frame on the display 18. The image data 48 may include, but is not limited to, input signals that the display 18 may utilize to produce the image frame on the display 18. The image data 48 may be instructions to display particular text, shapes, colors, and/or other objects on the display 18 in a particular image frame. The image data 48 may be generated by the process complex 12, retrieved from local memory 14, provided via input structures 22, provided by the network interface 26 and/or the I/O interface 24, or any combination thereof. A display backend 50 (e.g., image processing circuitry) receives the image data 48 and processes the image data 48 with one or more white point correction processes 52, as discussed below, to produce adjusted image data 54. In some embodiments, the display backend 50 is a part of the processor complex 12 (e.g., system on chip) of the electronic device 10. Additionally, or in the alternative, the display backend 50 is a part of the display 18. Regardless of the where the image data 48 is processed by the display backend 50 (e.g., image processing circuitry), the adjusted image data 54 is provided to the display 18 in place of the image data 48. Like the image data 48, the adjusted image data 54 may also be instructions to display particular text, shapes, colors, and/or other objects on the display 18 in a particular image frame; however, the white point correction process 52 generates the adjusted image data 54 based on properties of the display 18 that may otherwise affect the uniformity of the image frame produced on the display 18. Although the white point correction process 52 is shown as occurring in the display backend 50, the white point correction process 52 may be carried out in any other suitable data processing circuitry (e.g., as software running on the processor complex 12, as a process on a graphics processor, etc.).

Figure 8:
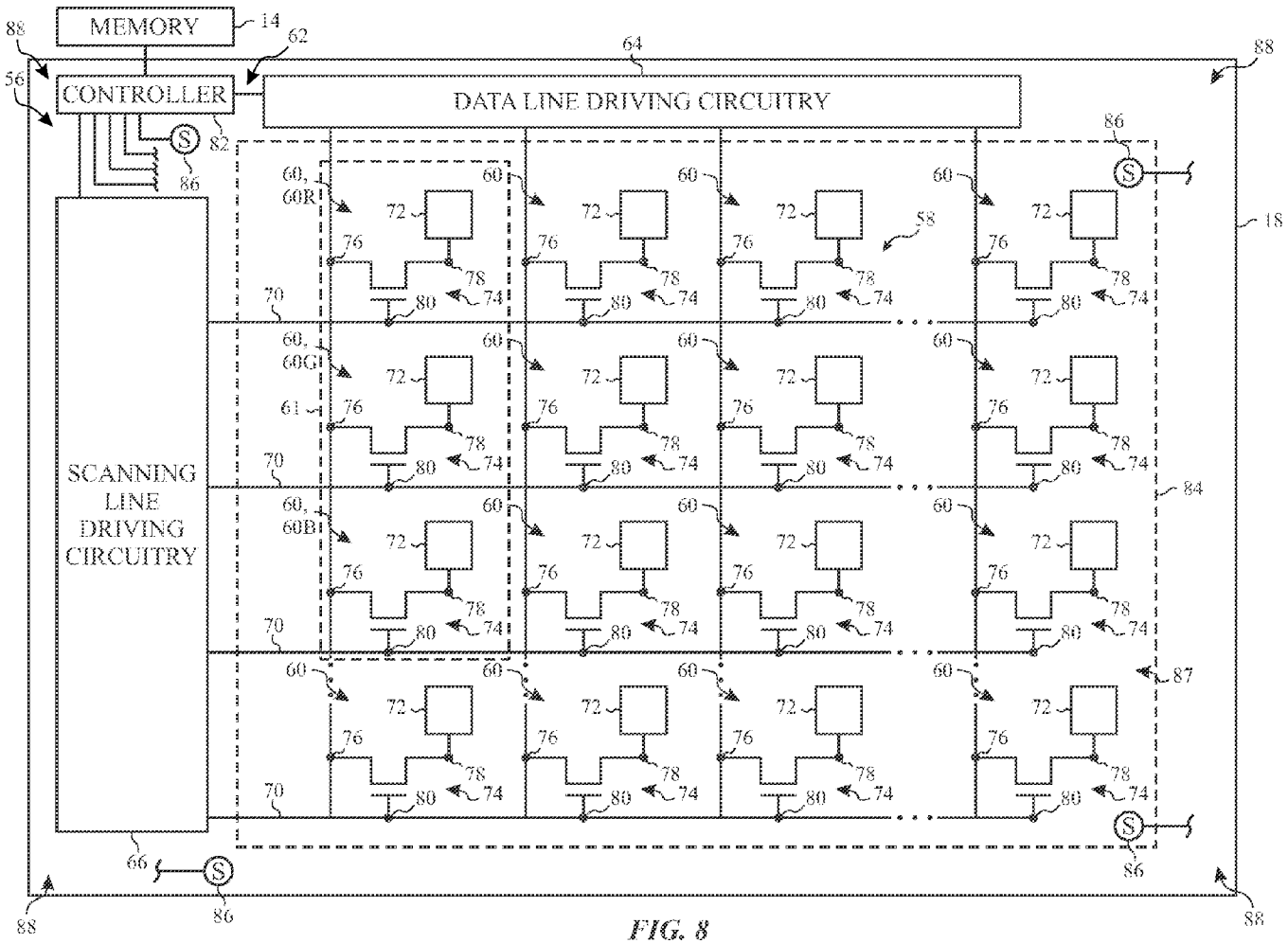
FIG. 8 is circuitry of pixels of a liquid crystal display (LCD) that may be found in an embodiment of the display of FIG. 1.
Figure 9:
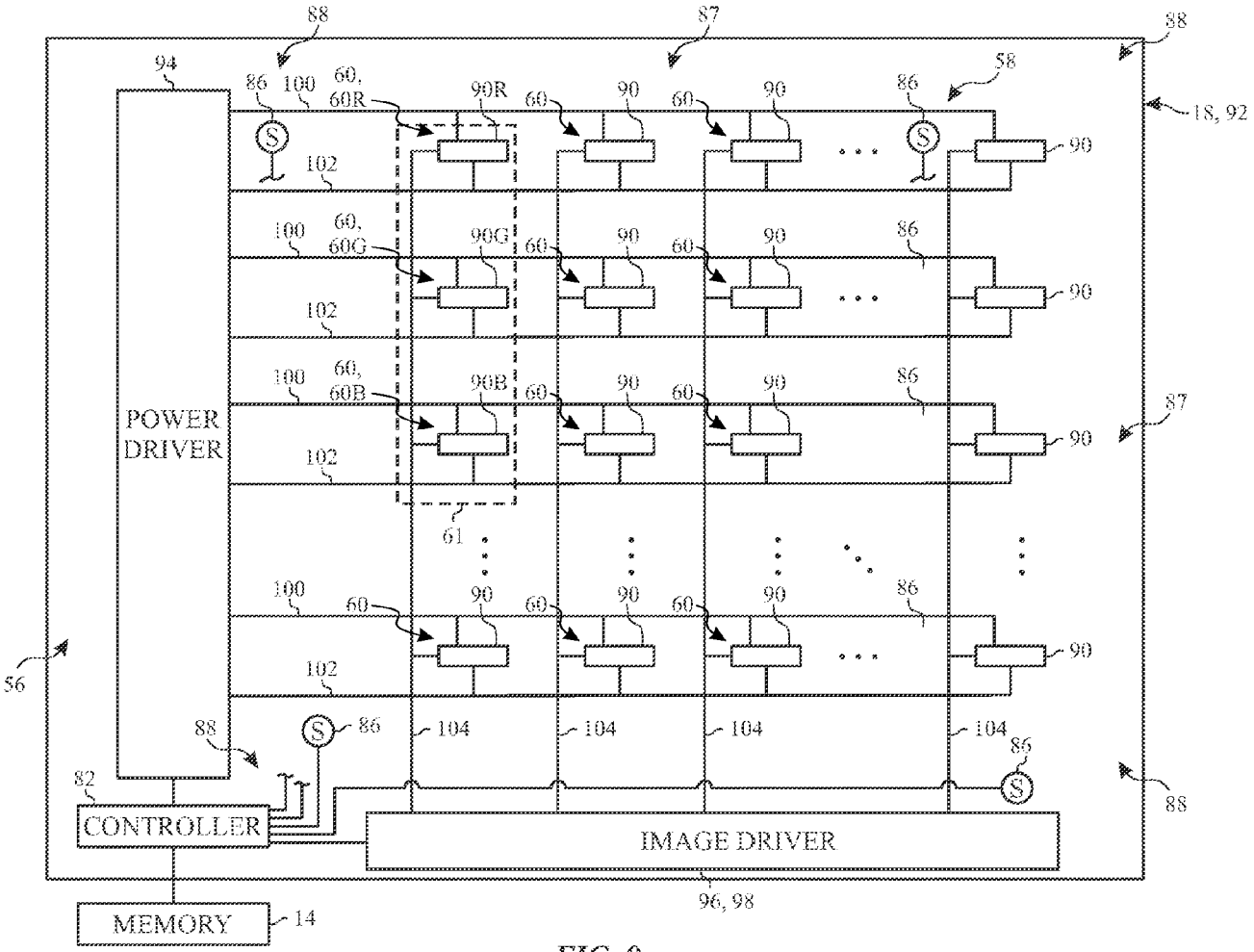
FIG. 9 is circuitry of pixels of an organic light emitting diode (OLED) device that may be found in an embodiment of the display of FIG. 1.

Indeed, as will be further appreciated, FIGS. 8 and 9 illustrate pixel driving circuitry 56 of displays 18 with pixel arrays 58. The pixel driving circuitry 56 is controlled to produce images on the display 18 via control of light emitted from the pixel arrays 58. Input signals (e.g., driving strengths) provided to each subpixel 60 of the respective pixel arrays 58 may be controlled to adjust the gain (e.g., luminance) of emitted light from each subpixel 60 based on one or more factors (e.g., display anomalies, temperature). Accordingly, the signals provided to each subpixel 60 may be controlled to align of an emitted white point of a pixel to a target white point for the display 18. The embodiment of the display 18 shown in FIG. 8 is pixel driving circuitry 56 of a liquid crystal display (LCD) panel 62. As may be appreciated, the LCD panel 62 may be disposed between a backlight and a front (e.g., cover glass) of the display 18, such that the LCD panel 62 controls the light emitted through the subpixels 60 of the pixel array 58 to produce the image on the display 18.

The pixel driving circuitry 56 includes the pixel array 58 of subpixels 60 that are driven by data (or source) line driving circuitry 64 and scanning (or gate) line driving circuitry 66. The display 18 may include multiple subpixels 60 disposed in the pixel array 58 or matrix defining multiple rows and columns of subpixels 60 that collectively form an image viewable region of the display. In such a matrix, each subpixel 60 may be defined by the intersection of data lines 68 and scanning lines 70, which may also be referred to as source lines 68 and gate (or video scan) lines 70. The data line driving circuitry 64 may include one or more driver integrated circuits (also referred to as column drivers) for driving the source lines 68. The scanning line driving circuitry 66 may also include one or more driver integrated circuits (also referred to as row drivers).

Although only sixteen subpixels 60 are shown for purposes of illustration, it should be understood that in an actual implementation of the pixel array 58, each source line 68 and gate line 70 may include hundreds, thousands, or millions of such subpixels 60. By way of example, in a color display 18 having a display resolution of 1024×768, each source line 68, which may define a column of the pixel array 58, may include 1024 groups of subpixels 60, wherein each group may include a red, blue, and green pixel, thus totaling 3072 subpixels per gate line 70. Although a display resolution of 1024×768 is mentioned by way of example above, the display 18 may include any suitable number of subpixels 60.

Each subpixel 60 includes a pixel electrode 72 and a transistor 74 for switching access to the pixel electrode 72. In the depicted embodiment, transistor 74 may be a thin film transistor (TFT), and a source 76 of each TFT 74 is electrically connected to a source line 68 extending from respective data line driving circuitry 64, and a drain 78 is electrically connected to the pixel electrode 72. Similarly, in the depicted embodiment, a gate 80 of each TFT 74 is electrically connected to a gate line 70 extending from respective scanning line driving circuitry 66.

Column drivers of the data line driving circuitry 64 may send image signals to the subpixels 60 via the respective source lines 68. Such image signals may be applied by line-sequence, i.e., the source lines 68 may be sequentially activated during operation. The gate lines 70 may apply scanning signals from the scanning line driving circuitry 66 to the gate 80 of each TFT 74. Such scanning signals may be applied by line-sequence with a predetermined timing or in a pulsed manner. Moreover, in certain embodiments, the scanning signals may be applied in an alternating manner in which every other line has scanning signals applied during a first sequence through the rows and the remaining lines have scanning signals applied during a second sequence through rows. Timing information may be provided to the data line driving circuitry 64 and/or the scanning line driving circuitry 66 from a controller 82 and/or the local memory 14 of the electronic device 10. In some embodiments, the controller 82 (e.g., data processing circuitry) is the main processor 12 (e.g., processor complex) of the electronic device 10, or a portion of the processor complex 12 (e.g., system on a chip SoC). In some embodiments, the controller 82 is a component of the display 18, separate from the processor complex 12 of the electronic device 10. While the illustrated embodiment shows only a single data line driving circuitry 64 component and a single scanning line driving circuitry 66 component for purposes of simplicity, it should be appreciated that additional embodiments may utilize multiple source driver integrated circuits 64, 66 for providing signals to the subpixels 60. For example, additional embodiments may include multiple data line driving circuits 64 disposed along one or more edges of the display 18, in which each data line driving circuit 64 is configured to control a subset of the source lines 68.

Each TFT 74 serves as a switching element which may be activated (e.g., turned "ON" or is active) and deactivated (e.g., turned "OFF" or is temporarily inactive) for a predetermined period based on the respective presence or absence of a scanning signal at its gate 80. When activated, a TFT 74 may store the image signals received via a respective source line 68 as a charge in the pixel electrode 72 with a predetermined timing.

The image signals stored at the pixel electrode 72 may be used to generate an electrical field between the respective pixel electrode 72 and a common electrode 84 (VCOM).

Such an electrical field may align liquid crystals with a liquid crystal layer to modulate light transmission through the LCD panel 62. Subpixels 60 may operate in conjunction with various color filters, such as red, green, blue, cyan, magenta, yellow, or any combination thereof. In such embodiments, a "pixel" 61 of the display 18 may actually include multiple subpixels 60, such as a red subpixel 60R, a green subpixel 60G, and a blue subpixel 60B, each of which may be modulated to increase or decrease the amount of light emitted through the respective subpixels 60. That is, the amount of light that may be transmitted through each subpixel 60 may correspond to the voltage applied to the respective subpixel 60 (e.g., from a corresponding source line 68), such that the voltage applied to each subpixel 60 affects the gain (i.e., brightness) of the respective subpixel 60. The modulated light emitted through the respective subpixels 60 of the pixel array 58 enable the display 18 to render numerous colors via additive mixing of the colors. As may be appreciated, control of the light emitted through a subpixel 60 may be referred to herein as control of the gain of the respective subpixel 60. Accordingly, the gain of a subpixel 60 of the LCD panel 62 is controlled by controlling the electrical field that affects the liquid crystals of the respective subpixel 60.

In some embodiments, the display 18 may have one or more temperature sensors 86 configured to measure a temperature of the portions of the display 18. Arrangements of temperature sensors 86 across the display 18 and/or near edges 87 of the display 18 (e.g., proximate to corners 88 of the display 18) may measure temperature at multiple points of the display 18. The controller 82 may determine (e.g., via interpolation, curve fitting, lookup table) temperatures at various points (e.g., subpixels 60) of the display 18 based at least in part on feedback from the temperature sensors 86. The one or more temperature sensors 86 may include, but are not limited to, thermocouples, thermistors, resistance thermometers, or combinations thereof. In some embodiments, the one or more temperature sensors 86 are coupled to or disposed on the common electrode 84. Additionally, or in the alternative, the controller 82 may determine the temperature at or near one or more subpixels 60 during operation of the display 18 via monitoring the current and/or the resistance of signals through the TFT 74 of the subpixel 60.

FIG. 9 illustrates an embodiment of pixel driving circuitry 56 of a display 18 in which the pixel array 58 includes an array of organic light emitting diodes (OLEDs) 90 that form an OLED display 92. Each OLED 90 is driven by a power driver 94 and an image driver 96 (collectively OLED drivers 98). Each power driver 94 and image driver 96 may drive one or more OLEDs 90. Each of the OLEDs 90 emit light at a known base brightness level and a known respective base color when driven with a known base drive strength (e.g., input signal) by the OLED drivers 98. In some embodiments, the OLED drivers 98 may include multiple channels for independently driving multiple OLEDs 90 with one OLED driver 98.

Each OLED 90 of the pixel array 58 may be a subpixel 60 that emits light of a known color (e.g., red, blue, yellow, cyan, magenta, yellow, white). The OLEDs 90 (i.e., subpixels 60) may be grouped in "pixels" 61 of the display 18, where each pixel 61 includes multiple subpixels 60, such as a red subpixel 60R (i.e., OLED 90R), a green subpixel 60G (i.e., OLED 90G), and blue subpixel 60B (i.e., OLED 90B). The light emitted from the subpixels 60 of each pixel 61 may be combined to produce various colors of light, including substantially white light. The white point of a light source (e.g., OLED display 92, backlight) is a set of chromaticity values used to compare light sources. The white point of a light source is associated with its color and its component lights. With respect to the pixels 61 of an OLED display 92, the appropriate driving strength for each subpixel 60 (e.g., OLED 90) to maintain a white point of an image frame shown on the display 18 may change due to numerous factors, including temperature, use, location of the subpixel within the OLED display 92, and intervening layers (e.g., protective display cover, polarizing layer, touch interface) between the pixel driving circuitry 56 and the front of the display 18.

The power driver 94 may be connected to the OLEDs 90 by way of scan lines 100 and driving lines 102. The OLEDs 90 receive activate instructions (e.g., turn "ON") and deactivate instructions (e.g., turn "OFF" temporarily) through the scan lines 100, and the OLEDs 90 receive driving currents corresponding to data signals (e.g., currents, voltages) transmitted from the driving lines 102. The driving currents are applied to each OLED 90 to emit light according to instructions from the image driver 96 through driving lines 104. Both the power driver 94 and the image driver 96 transmit voltage signals (e.g., input signals) through respective driving lines 102, 104 to operate each OLED 90 at a state determined by the controller 82 to emit light.

The drivers 98 may include one or more integrated circuits that may be mounted on a printed circuit board and controlled by controller 82. The drivers 98 may include a voltage source that provides a voltage to the OLEDs 90 (e.g., subpixels 60) for example, disposed between anode and cathode ends of an OLED layer of the display 18. This voltage from the drivers 98 causes current to flow through the OLEDs 90, thereby causing the OLEDs 90 to emit light. The drivers 98 also may include voltage regulators. In some embodiments, the voltage regulators of the drivers 98 may be switching regulators, such as pulse width modulation (PWM) or amplitude modulation (AM) regulators. Drivers 98 using PWM adjust the voltage signals by varying the duty cycle. For example, the power driver 94 may increase the frequency of a voltage signal to increase the driving strength for an OLED 90, which may increase the gain of the light emitted from the respective OLED 90. Drivers 98 using AM adjust the amplitude of the voltage signal to adjust the driving strength.

Each driver 98 may supply voltage signals (e.g., input signals) at a duty cycle and/or amplitude sufficient to operate each OLED 90. The amount of light transmitted by each subpixel 60 (e.g., OLED 90) may correspond to the voltage signals (e.g., driving strength) applied to the respective subpixel 60, such that the voltage signals applied to each subpixel 60 affects the gain of the respective subpixel 60. Furthermore, the color of light transmitted by each subpixel 60 (e.g., OLED 90) may correspond to the voltage signals (e.g., driving strength) applied to the respective subpixel 60. When the drive strength is adjusted, like by PWM or AM, the light emitted from an OLED 90 will vary from the base brightness and base color. For example, the duty cycles for individual OLEDs 90 may be increased and/or decreased to produce a color or brightness that substantially matches a target color or brightness for each OLED 90. Furthermore, over time, the color and brightness of emitted light from an OLED 90 will also vary due to temperature and age even when driven with the original drive strength. In some embodiments, the controller 82 may adjust the drive strength of an OLED 90 throughout its useful life during operation of the OLED display 92 such that the color and/or the brightness of its emitted light remains substantially the same, or at least the same relative to other OLEDs 90 of the display 18. In some embodiments, the controller 82 may increase the gain (i.e., brightness) of an OLED 90 by increasing the voltage signal (e.g., driving strength) applied to the OLED 90, and the controller 82 may decrease the gain of an OLED 90 by decreasing the voltage signal (e.g., driving strength) applied to the OLED 90. Moreover, in some embodiments, the ratio of the voltages applied to a group (e.g., one or more pixels 61) of OLEDs 90 may be adjusted to substantially match the gain of other OLEDs 90 while maintaining a relatively constant emitted color of mixed light from the group of OLEDs 90.

Similar to the LCD panel 62 of FIG. 8, some embodiments of the OLED display 92 shown in FIG. 9 may have one or more temperature sensors 86 configured to measure a temperature of the portions of the display 18. Arrangements of temperature sensors 86 across the display 18 and/or near edges 87 of the display 18 (e.g., proximate to corners 88 of the display 18) may measure temperature at multiple points (e.g., corners) of the display 18. The controller 82 may determine (e.g., via interpolation, curve fitting, lookup table) temperatures at various points (e.g., subpixels 60) of the display 18 based at least in part on feedback from the temperature sensors 86. As mentioned above, the one or more temperature sensors 86 may include, but are not limited to, thermocouples, thermistors, resistance thermometers, or combinations thereof.

As described above, the controller 82 may control the gain of light emitted through subpixels 60 (e.g., pixel electrodes 72), and the controller 82 may control the gain of light emitted from subpixels 60 (e.g., OLEDs 90). The controller 82 may control each subpixel 60 to increase the uniformity of light emitted from the display 18, such as to align the emitted white point of the display 18 with a target white point. Moreover, controllers 82 of multiple electronic devices 10 may control the subpixels 60 of their respective electronic devices 10 such that the emitted white point of each electronic device 10 is substantially the same (e.g., the target white point), thereby reducing display non-uniformities among the multiple electronic devices 10 (e.g., mobile phone, tablet computer, clock, and so forth).

The controller 82 of each electronic device 10 may control the gain of each subpixel 60 and/or groups of subpixels 60 based on one or more factors including, but not limited to temperature of the subpixel 60, location of the subpixel 60 within the display 18, and intervening layers (e.g., protective display cover, touch interface) between the pixel driving circuitry 56 and the front of the display 18. Without controlling the input signals applied to the subpixels 60 as described herein, the display 18 may produce image frames with non-uniform brightness and/or colors. For example, an image frame produced by a display in which the input signals are not modified as described herein may have portions of the display that do not emit light corresponding to the desired target white point. For example, differences in stress on layers (e.g., TFT layer, color filter, polarizer, cover glass) may affect the uniformity of a displayed image frame unless input signals to at least some of the subpixels of the display are controlled as described herein. Additionally, or in the alternative, edge effects on one or more layers of the display may affect the uniformity of a displayed image frame unless input signals to at least some of the subpixels of the display are controlled as described herein.

Figure 10:
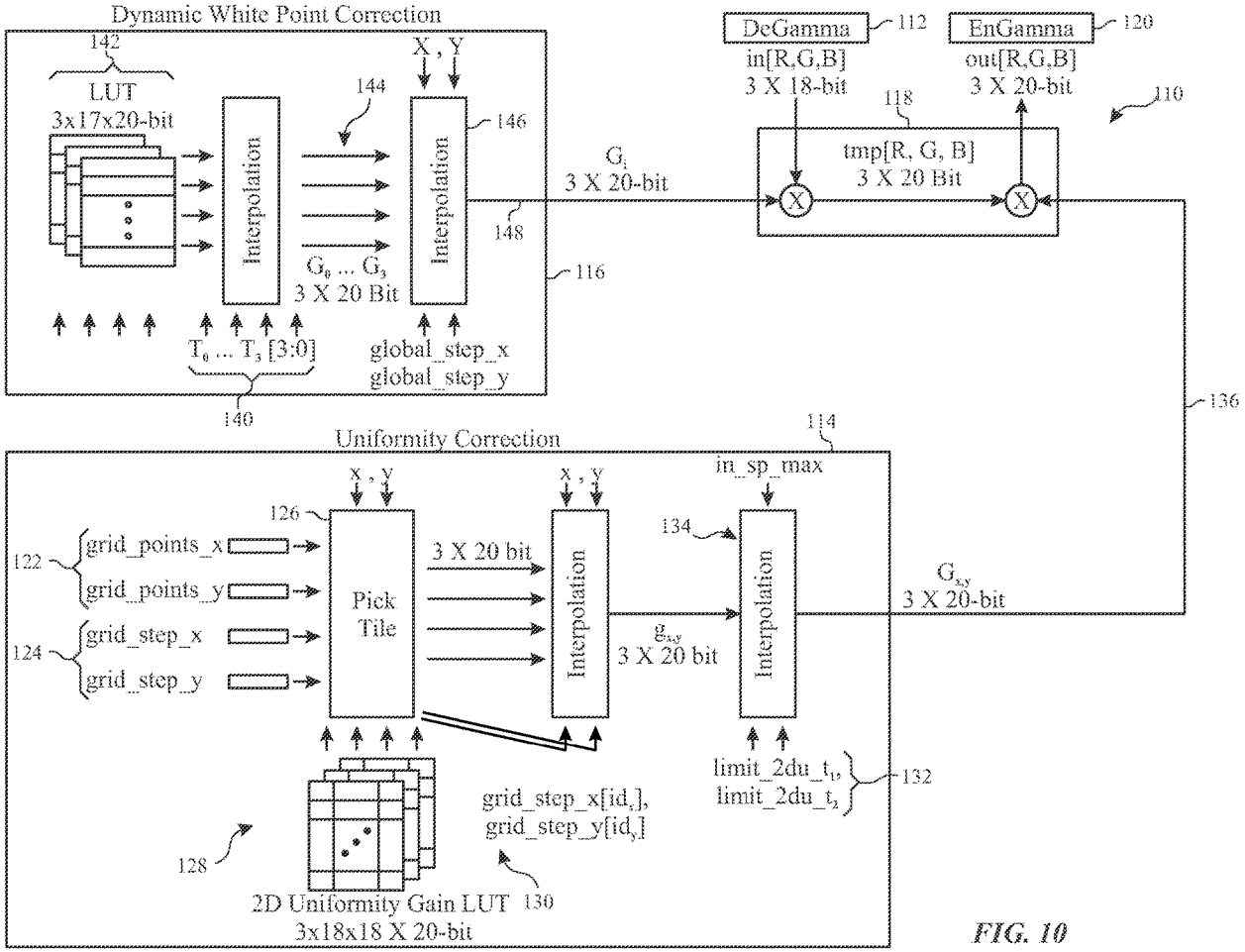
FIG. 10 is a flowchart of a method for processing the input signals to adjust the gain of the pixels of the display of FIG. 1.

The controller 82 may adjust the input signals supplied to the subpixels 60 of a display to control the gain of light from the subpixels 60 using an embodiment of the method 110 illustrated in FIG. 10. Pixel input signals to the controller 82 may be data configured in a gamma corrected color space (e.g., sRGB). The controller 82 or another processor coupled to the controller 82 may convert (block 112) the pixel input signals to a linear space. This conversion (block 112) may be referred to as a DeGamma process. As may be appreciated, the human eye may perceive light and color in a non-linear manner such that the human eye may be more sensitive to relative differences between darker tones than between lighter tones. However, conversion of the pixel input signals to a linear space facilitates adjusting the gain with less complex algorithms than directly adjusting the input signals configured in the gamma corrected color space. The DeGamma process (block 112) may utilize a lookup table (LUT) to determine the pixel input signal for each color (e.g., red, green, blue). In some embodiments, the input signals from the DeGamma process (block 112) for the image frame corresponding to each subpixel (e.g., red, green, blue) may be an 18-bit signal.

After the pixel input signals are converted to a linear space, the controller 82 may determine adjustments to the pixel input signals for each subpixel to compensate for properties of the display 18. The controller 82 may determine the adjustments to enable the emitted white point from the pixels 61 across the display 18 to substantially match a target white point for the image frame. That is, the controller 82 may adjust the input signals to increase the uniformity of light from the pixels 61 across the display 18. The properties that may be adjusted for may include, but are not limited to uniformity differences in the display 18 (e.g., manufacturing effects, LCD cell gap variation, location of electronic components around the display 18) and/or thermal gradients across the display 18. Accordingly, the controller 82 may process the input signals for the image frame through a uniformity white point correction process 114 and/or a dynamic white point correction process 116, each of which are discussed in detail below.

As discussed in detail below, the uniformity white point correction process 114 may utilize grid points 122 corresponding to points (e.g., coordinates) of an image frame to be produced on the display 18. Each coordinate may be spaced apart from other coordinates within the image frame by step distances 124 thereby forming a grid. In some embodiments, the step distances 124 may vary across the display, such that the coordinates of the image frame correspond to a non-uniform array of grid points 122, and in turn to a non-uniform array of points on the display. Sets of grid points 122 may be identified with regions 126 (e.g., tiles) of the image frame. The uniformity white point correction process 114 determines adjustment gains 128 for each of the grid points 122 corresponding to points (e.g., coordinates) of the image frame. In some embodiments, the adjustment gains for each of the grid points 122 corresponding to points of the image frame is determined via a uniformity lookup table. The determined adjustment gains for the grid points 122 corresponding to points (e.g., coordinates) of each region 126 of the image frame may be utilized to indirectly determine 130 the adjustment gains for points corresponding to the image frame within the region 126. In some embodiments, the adjustment gains indirectly determined for points corresponding to each region 126 of the image frame may be stored and/or transmitted as a 20-bit signal. Accordingly, the uniformity gain adjustments to input signals for a pixel of the display 18 with three subpixels (e.g., red, green, blue) may be stored and/or transmitted as three 20-bit signals. Uniformity thresholds 132 may be applied 134 to the uniformity adjustment gains, such as to adjust for differences between the target white point of a pixel and an input signal for a non-white color. Accordingly, an output 136 for the uniformity white point correction process 114 may be an adjusted gain corresponding to each pixel of an image frame to be produced on the display 18. In some embodiments, the output 136 from the uniformity white point correction process of input signals to a pixel may be three 20-bit signals, corresponding to uniformity gain adjustments for each of the three subpixels (e.g., red, green, blue) of the pixel of the image frame to be produced on the display 18. As may be appreciated, the uniformity white point correction process 114 may generate outputs 136 to adjust the gain for each subpixel 60 of an image frame to be produced on the display 18.

As discussed in detail below, the dynamic white point correction process 116 may utilize temperature inputs 140 corresponding to points of an image frame to be produced on the display 18. The temperature inputs 140 and a lookup table 142 may be utilized to determine the gain adjustments 144 at the corresponding points of the image frame. Where temperature gain adjustments for the temperature inputs 140 are not explicitly in the lookup table 142, interpolation may be used. In some embodiments, there are four temperature inputs 140 corresponding to the approximate temperature of corners of the display 18, as measured by one or more temperature sensors 86. In some embodiments, gain adjustments 144 may be directly determined with the temperature inputs 140 for subpixels corresponding to points (e.g., coordinates) of the image frame. For example, the lookup table 142 may be utilized to determine twelve temperature gain adjustments 144 corresponding to four sets of three subpixels at the corners of the image frame. The determined temperature gain adjustments 144 corresponding to the temperature inputs 140 may be utilized to indirectly determine 146 (e.g., via interpolation) the gain adjustments 148 for the other pixels/subpixels corresponding to points (e.g., coordinates) within the image frame. In some embodiments, the directly determined temperature gain adjustments 144 and the indirectly determined temperature gain adjustments 148 corresponding to points (e.g., coordinates) of the image frame may be stored and/or transmitted as a 20-bit signal. Accordingly, the temperature gain adjustments 144, 148 to input signals for a pixel of the display 18 with three subpixels (e.g., red, green, blue) may be stored and/or transmitted as three 20-bit signals.

In some embodiments, the dynamic white point correction process 116 may utilize brightness inputs (e.g., desired brightness, measured brightness) corresponding to points of the image frame in a similar manner as the temperature inputs 140 described above. The brightness inputs and the lookup table 142 may be utilized to determine the gain adjustments 144 at the corresponding points of the image frame. In some embodiments, the brightness setting of a backlight or OLEDs may affect the color of the light of the backlight or OLEDs, respectively. Accordingly, the lookup table 142 may include gain adjustments 144 to the input signals to compensate for color changes of the backlight or OLEDs based at least in part on the brightness inputs corresponding to points of the image frame.

After processing the pixel input signals through at least one of the uniformity white point correction process 114 and the dynamic white point correction process 116, the controller 82 resolves (block 118) the pixel input adjustments. For example, the uniformity white point correction adjustment 136 for a subpixel 60 may be a multiplication of the linear space pixel input from the DeGamma 112 by a factor of 0.95, and the dynamic white point correction adjustment 148 for the same subpixel 60 may be a multiplication of the linear space pixel input from the DeGamma 112 by a factor of 0.8. At block 118, the controller 82 may resolve the adjustment by multiplying the uniformity and dynamic white point correction adjustments (i.e., 0.95×0.8=0.76) to the input signals, then multiplying the product by the linear space pixel input from the DeGamma Where only one of the uniformity or dynamic white point correction processes 114, 116 is utilized, the adjustment may be resolved (block 118) by multiplying the determined adjustment (e.g., 136, 148) to the input signal by the linear space pixel input from the DeGamma. The controller 82 or another processor coupled to the controller 82 may convert (block 120) the adjusted linear space pixel input signals to a non-linear space (e.g., gamma corrected color space such as sRGB). This conversion (block 120) may be referred to as an EnGamma process. The adjusted pixel input converted to the non-linear space controls the light from the subpixels, such that images shown on the display 18 (e.g., the image frame) have the desired properties (e.g., uniform white point). The EnGamma process (block 120) may utilize a lookup table (LUT) to determine the adjusted pixel input signal for each color (e.g., red, green, blue) from the respective adjusted linear space pixel input signal. In some embodiments, the input signals provided to the EnGamma process (block 120) corresponding to each subpixel (e.g., red, green, blue) may be a 20-bit signal, and the output from the EnGamma process (block 120) may be a 14-bit signal.

The controller 82 may directly determine the appropriate white point correction gain adjustments for the input signals to a subset of the subpixels 60 of the pixel array 58, and the controller 82 may indirectly determine the appropriate white point correction gain adjustments for the input signals to a remainder of the subpixels 60. For example, the controller 82 may utilize a lookup table to determine the appropriate white point correction gain adjustments for the input signals to the subset of subpixels 60 where the subset of subpixels 60 is spaced across the display 18. The subset of subpixels 60 may be arranged to form a grid in the image frame. The controller 82 may indirectly determine the appropriate white point correction gain adjustments for the remainder of subpixels that are disposed among the subset of subpixels 60 (e.g., within the grid of the image frame). In some embodiments, the controller 82 may indirectly determine the appropriate white point correction gain adjustment for the remainder of the subpixels 60 via interpolation (e.g., linear interpolation, bilinear interpolation, polynomial interpolation, spline interpolation) with the directly determined white point correction gain adjustments for the subset of subpixels 60.

Figure 11:
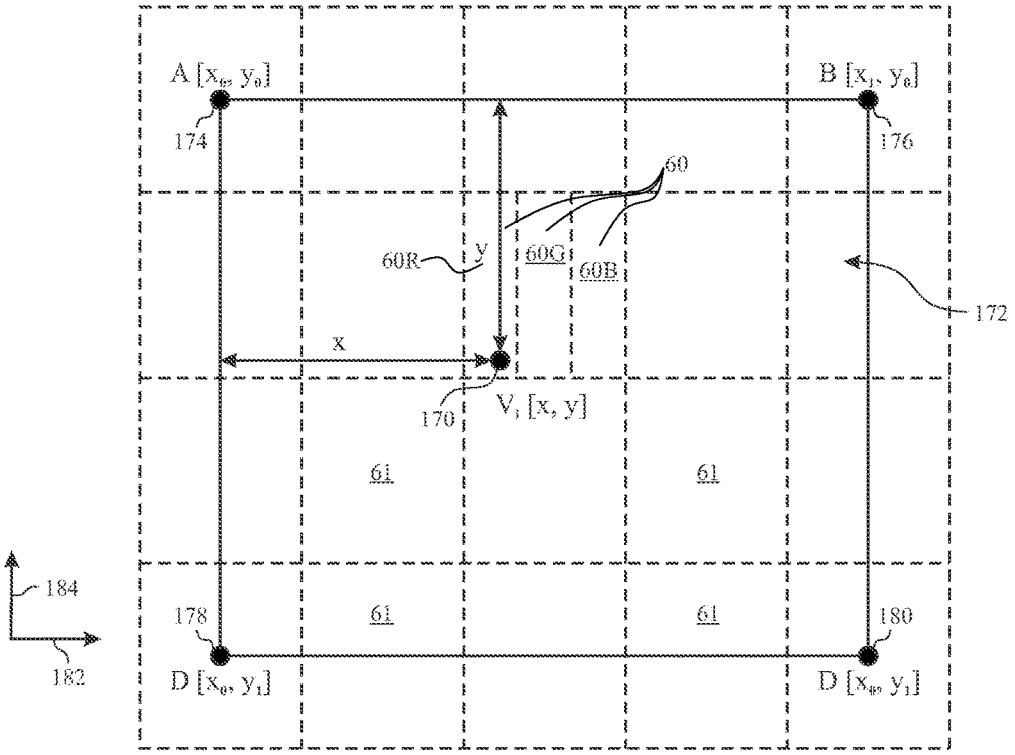
FIG. 11 is an embodiment of a graphical representation of grid points that may be utilized with bilinear interpolation.

FIG. 11 illustrates an embodiment of a graphical representation of grid points that may be utilized to indirectly determine gain adjustments, such as via bilinear interpolation. Values stored in memory, such as a gain table, may correspond to the gain adjustments for the input signals provided to subpixels 60 in a portion 172 of an image frame that is to be produced on the display 18. For example, a gain adjustment value V, corresponding to a point 170 in the portion 172 of the image frame may be indirectly determined based on the gain adjustment values A, B, C, and D that respectively correspond to known points 174, 176, 178, and 180 of the same portion 172. In some embodiments, each of the points 170, 174, 176, 178, and 180 may correspond to gain adjustments for a pixel 61, which may have one or more subpixels (e.g., red, green, blue). In some embodiments, the points 174, 176, 178, and 180 may correspond to gain adjustments for points (e.g., subpixels 60) on an interior portion of the image frame to appear on the display 18. In some embodiments, the points 174, 176, 178, and 180 correspond to the corners 88 of the image frame that appear on the display 18 and/or to the positions of temperature sensors 86 relative to the image frame. As shown in FIG. 11, the point 174 (e.g., gain adjustment value A) has coordinates $[x_0, y_0]$ within the portion 172 of the image frame, the point 176 (e.g., gain adjustment value B) has coordinates $[x_1, y_0]$ within the portion 172 of the image frame, the point 178 (e.g., gain adjustment value C) has coordinates $[x_0, y_1]$ within the portion 172 of the image frame, and the point 180 (e.g., gain adjustment value D) has coordinates $[x_1, y_1]$ within the portion 172 of the image frame. Point 170 corresponds to coordinates [x,y] within the portion 172 of the image frame, such that point 170 is spaced a linear distance x from coordinate $x_0$ of the image frame, and the point 170 is spaced a linear distance y from coordinate $y_0$ of the image frame.

The gain adjustment values A, B, C, and D may be directly determined (e.g., via a lookup table) or known values (e.g., via stored data in memory, user input) for the image frame to be produced on the display 18. As may be appreciated, bilinear interpolation may be generalized as a linear interpolation in a first direction 182 (e.g., parallel to the linear distance x), and a second linear interpolation in a second direction 184 (e.g., parallel to linear distance y, perpendicular to the first direction). The gain adjustment value $V_i$ may be indirectly determined via bilinear interpolation according the following equation:

$$V_i = \frac{1}{(x_2 - x_1)(y_2 - y_1)}(A(x_2 - x)(y_2 - y) + B(x - x_1)(y_2 - y) + C(x_2 - x)(y - y_1) + D(x - x_1)(y - y_1))$$

A gain adjustment value V may be determined for each point (e.g., subpixel 60) within the portion 172 of the image frame via bilinear interpolation based on the known gain adjustment values A, B, C, and D. For example, the uniformity white point correction process 114 may determine the gain adjustment values A, B, C, and D at certain points (e.g., grid points corresponding to input signals for subpixels 60) within the portion 172 of the image frame utilizing a lookup table, then utilize bilinear interpolation to determine gain adjustment values V for other points (e.g., points corresponding to input signals for subpixels 60) within the portion 172 of the image frame. Likewise, the dynamic white point correction process 116 may determine the gain adjustment values A, B, C, and D at certain points (e.g., temperature sensors) within the portion 172 of the image frame utilizing a lookup table, then utilize bilinear interpolation to determine gain adjustment values V for other points (e.g., points corresponding to input signals for subpixels 60) within the portion 172 of the image frame. In some embodiments, the indirectly determined gain adjustment values V may be gain adjustments for pixels 61, such that the input signals to the different subpixels 60 (e.g., red, green, blue) of a given pixel are adjusted by the same gain adjustment value V. In some embodiments, the controller 82 determines the gain adjustment values A, B, C, and D for each group (e.g., red, green, blue) of subpixels 60, and then indirectly determines the gain adjustment values V for each subpixel 60 within the portion 172 of the image frame based on the respective gain adjustment values A, B, C, and D for the respective group. That is, the controller 82 may indirectly determine gain adjustment values $V_{red}$ for each red subpixel 60R of the portion 172, the controller 82 may indirectly determine gain adjustment values $V_{green}$ for each green subpixel 60G of the portion 172, and the controller 82 may indirectly determine gain adjustment values $V_{blue}$ for each blue subpixel 60B of the portion 172 of the image frame to appear on the display 18.

In some embodiments, the portion 172 of the image frame graphically represented in FIG. 11 may correspond to substantially the entire display, where the values A, B, C, and D for appropriate gain adjustments to the input signals for subpixels 60 are known and/or directly determined. The gain adjustment values to the input signals for subpixels 60 at points (e.g., coordinates) within the interior of image frame are indirectly determined based on the known points (e.g., grid points). As may be appreciated, the quality of the indirectly determined gain adjustment values may be based at least in part on the distance (e.g., x, y,) within the image frame of the interpolated point (e.g., 170) from the grid points (e.g., 174, 176, 178, 180) with known and/or directly determined values. Increasing the quantity of grid points across the image frame may decrease the distance within the image frame between the interpolated points and the grid points, thereby increasing the quality of the indirectly determined gain adjustment values. Improved quality of the indirectly determined gain adjustment values may facilitate improvement of the uniformity of the light emitted from the subpixels 60 for the image frame produced on the display 18.

An unadjusted display may have non-uniformities from the top of the display to the bottom of the display, from the left of the display to the right of the display, from the edges of the display to the center of the display, or any combination thereof. The non-uniformities of an unadjusted display may be based at least in part on the arrangement of a backlight, manufacturing processes of components of the display, the temperature of the display, or any combination thereof.

Figure 12:
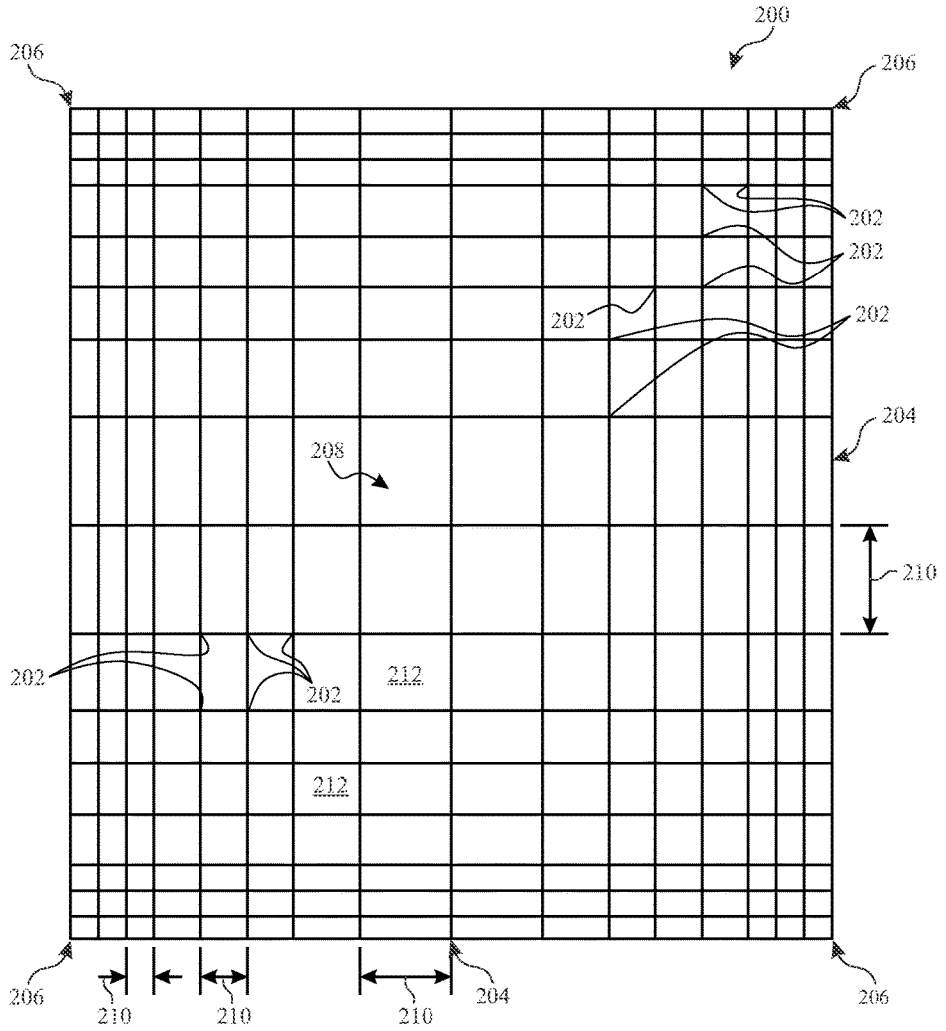
FIG. 12 is an embodiment of a graphical representation of non-uniformly spaced grid points.
Figure 13:
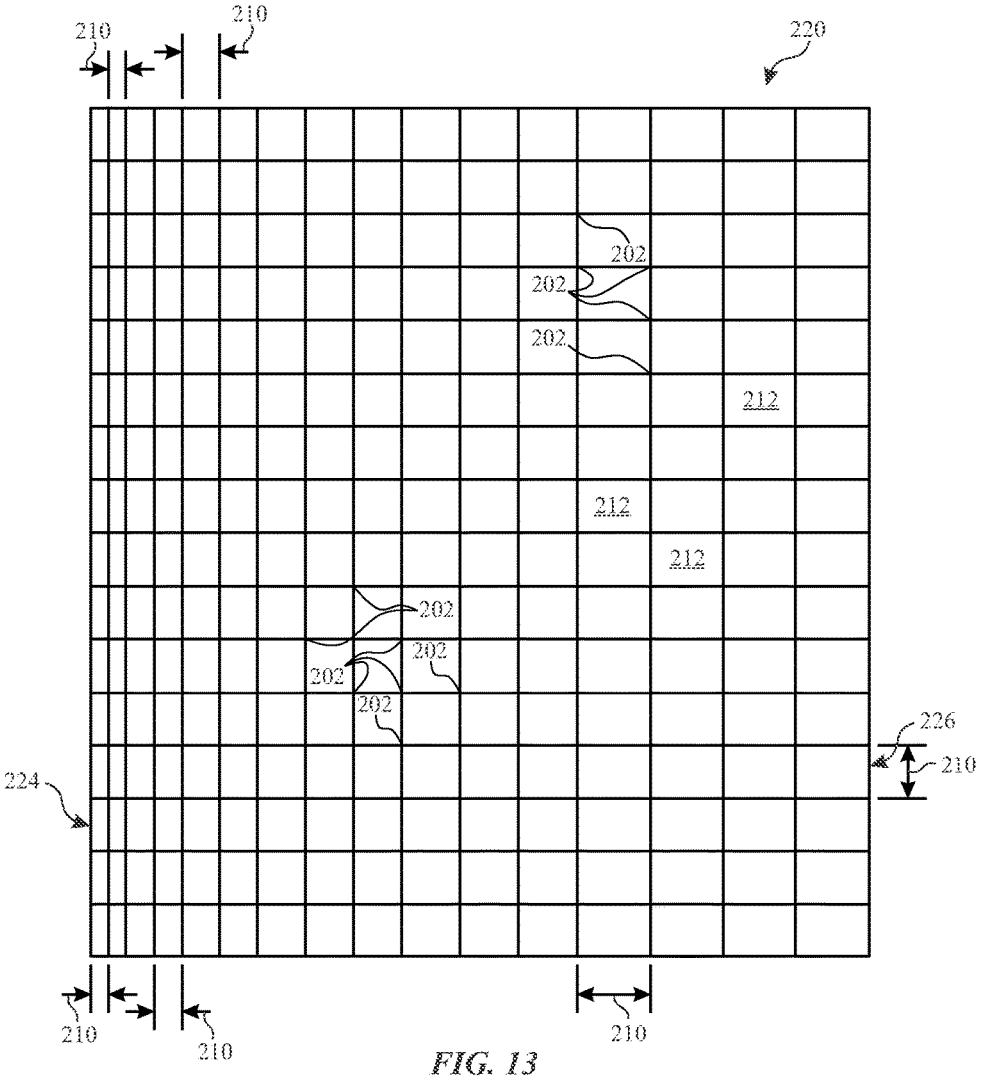
FIG. 13 is an embodiment of a graphical representation of non-uniformly spaced grid points.
Figure 14:
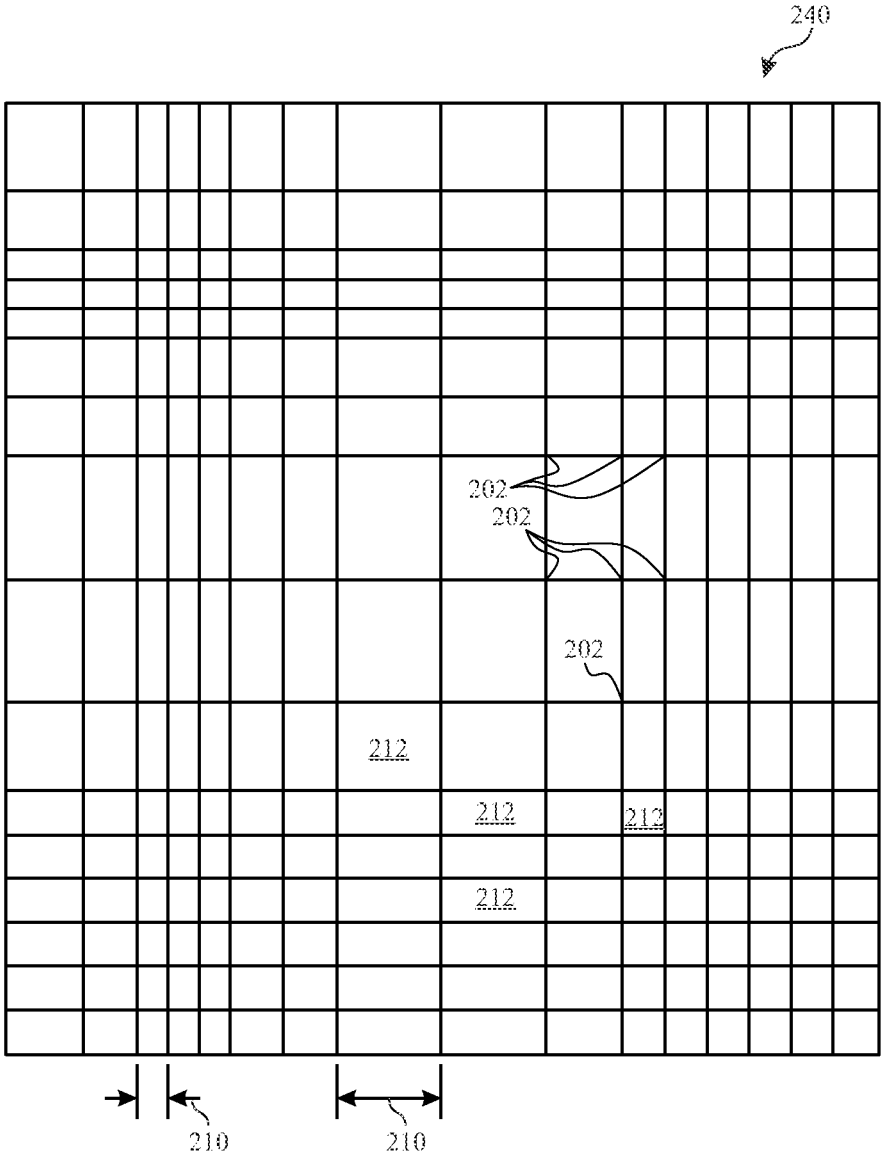
FIG. 14 is an embodiment of a graphical representation of non-uniformly spaced grid points.

FIG. 12 illustrates an embodiment of a graphical representation of an array 200 of grid points 202 for which the appropriate gain adjustments corresponding to input signals for subpixels 60 of the image frame are to be known and/or directly determined (e.g., via a lookup table). The array 200 of grid points 202 of FIG. 12 is denser at edges 204 and corners 206 of the image frame than at an interior 208 of the image frame. That is, a spacing 210 between grid points 202 of the array 200 may facilitate adjustments to the gain of the image frame based on edge effects of components of the display 18 and/or the manufacturing of the display 18. FIG. 13 illustrates an embodiment of a graphical representation of a different array 220 of grid points 202 for which the appropriate gain adjustments corresponding to input signals for subpixels 60 of the image frame are to be known and/or directly determined (e.g., via a lookup table). The array 220 of grid points 202 of FIG. 13 is denser at a first edge 224 than at a second opposite edge 226 of the image frame, which correspond to respective edges of the display 18. In some embodiments, the array 220 may facilitate adjustments to the gain of the image frame based on backlight uniformities of an edge lit display where the backlight (e.g., light emitting diodes, fluorescent tube) is arranged on the edge of the display 18 corresponding to the first edge 224 of the image frame. FIG. 14 illustrates another embodiment of a graphical representation of another array 240 of grid points 202 for which the appropriate gain adjustments corresponding to input signals for subpixels 60 of the image frame are to be known and/or directly determined (e.g., via a lookup table). The array 240 of grid points 202 of FIG. 14 has a non-uniform arrangement of grid points 202 across the image frame to facilitate adjustments to the gain based on non-uniform factors that may affect the image quality of the image frame on the display 18. As may be appreciated, any arrangement of grid points 202 and spacing 210 between the grid points 202 of an array corresponding to input signals for subpixels 60 of an image frame may be utilized, so long as the grid points 202 correspond to known and/or directly determined gain adjustment values of input signals for subpixels 60 of the image frame.

Figure 15:
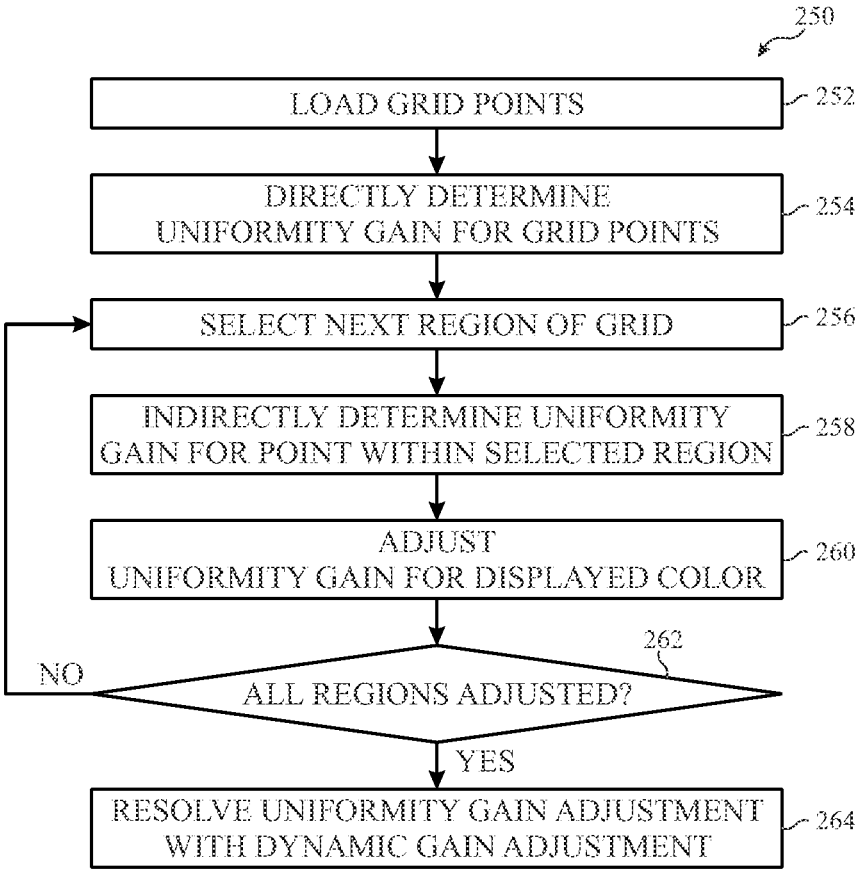
FIG. 15 is a flowchart of a method for uniformity gain adjustment of input signals to the pixels of the display of FIG. 1.

The uniformity white point correction process 114 may utilize an array of grid points 202, such as one of the arrays 200, 220, 240 described above and graphically represented in FIGS. 12-14, to facilitate adjustments to the gain of input signals for subpixels 60 to improve uniformity across the display 18. FIG. 15 illustrates a method 250 of executing the uniformity white point correction process 114 utilizing an array of grid points 202. Referring to above, FIG. 7 the display backend 50 (e.g., image processing circuitry) may execute the method 250 to adjust the image data provided to the display 18. The controller 82 loads (block 252) the grid points from the local memory 14 and/or the main memory storage 16. The grid points may be loaded as one or more vectors with some values representing the spacing (e.g., non-uniform spacing) between the grid points. As illustrated in FIGS. 12-14 above, the grid points 202 may correspond to input signals for pixels 61 and/or subpixels 60 of the image frame such that multiple regions 212 (e.g., tiles) of the image frame may be identified with grid points 202 forming the corners of the respective regions 212. In some embodiments, the grid points 202 form 4, 8, 16, 64, 256, 1024, 4096 or more regions 212 across the image frame. The controller 82 may determine (block 254) the uniformity gain adjustments for the input signals corresponding to the pixels 61 at each of the grid points 202 of the image frame. In some embodiments, the controller 82 may determine (block 254) the uniformity gain adjustments for the input signals of each subpixel 60 (e.g., red subpixel 60R, green subpixel 60G, blue subpixel 60B) corresponding to the grid points 202 of the image frame. As may be appreciated, the uniformity gain adjustment for each subpixel 60 of a pixel 61 may vary based on the color of the subpixel 60 in order to align the mixed light from the pixel 61 with the target white point for the pixel 61 of the image frame. Accordingly, the controller 82 may determine values of a grid point gain adjustment vector corresponding to the uniformity gain adjustments to input signals for each subpixel 60 at each grid point 202 of the image frame.

In some embodiments, the controller 82 determines (block 254) the uniformity gain adjustments at each grid point 202 of the image frame utilizing a uniformity gain lookup table (LUT). The uniformity gain LUT is based at least in part on the non-uniformities of the display 18, such as edge effects and/or effects of the manufacturing process. The data of the uniformity gain LUT may be determined in advance of operation of the display 18 and stored within the local memory 14 and/or main memory storage 16 of the electronic device 10. As may be appreciated, the controller 82 may determine the uniformity gain adjustments at each grid point 202 of the image frame utilizing the uniformity gain LUT faster than via computation of the gain adjustments via a computation.

Upon determination of the uniformity gain adjustments at each grid point 202 of the image frame, the controller 82 may select (block 256) a region 212 of the grid for which the gain adjustments to the input signals have not yet been determined. The controller 82 may then indirectly determine (block 258) the uniformity gain adjustment for points (e.g., pixels 61, subpixels 60) within the selected region 212 of the image frame to appear on the display 18. For example, the controller 82 may utilize the grid points 202 of the selected region 212 with bilinear interpolation and the equation described above with FIG. 11 to indirectly determine the uniformity gain adjustments within the selected region 212 of the image frame. The determined uniformity gain adjustments from blocks 254 and 258 may be optimized for display of white pixels 61 that matches the target white point. Consequently, as the difference of the desired color of a pixel increase with respect to the target white point, the appropriateness of the uniformity adjustment for the pixel decreases. That is, the uniformity gain adjustment for when the light from a pixel 61 is to align with the target white point may not be the appropriate uniformity gain adjustment for when the light from the pixel 61 of the image frame is to be another color (e.g., dark brown). Accordingly, a scaling factor may be applied to the determined uniformity adjustment gains to adjust (block 260) the uniformity gain for the displayed color of the image frame.

The controller 82 will determine at node 262 if all of the regions 212 of the image frame to be produced on the display have been adjusted. If at least one region 212 of the image frame remains that is unadjusted, the controller 82 may select the next region (block 256), indirectly determine the uniformity gain adjustment for points within the selected region (block 258) and adjust the uniformity gain adjustment for the displayed color (block 260). When each region 212 of the image frame has been adjusted, the controller 82 may resolve (block 264) the uniformity gain adjustment with the dynamic gain adjustment, if any dynamic gain adjustment is determined. This resolved gain adjustment to an input signal may be referred to herein as a total gain adjustment. In some embodiments, the uniformity gain adjustment for each pixel 61 and/or subpixel 60 of the image frame may be stored in memory until the total gain adjustment is determined. As discussed above with FIG. 10, the controller 82 may resolve (block 118 and block 264) the gain adjustments by multiplying the uniformity and dynamic gain adjustments to the input signals, then multiplying the product by the linear space pixel input from the DeGamma.

Figure 16:
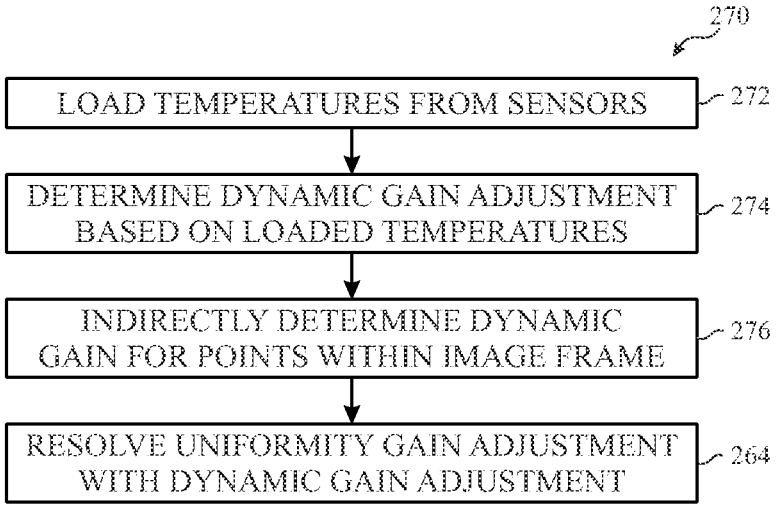
FIG. 16 is a flowchart of a method for dynamic gain adjustment of input signals to the pixels of the display of FIG. 1.

FIG. 16 illustrates a method 270 of executing the dynamic white point correction process 116 of FIG. 10. Referring to FIG. 7 above, the display backend 50 (e.g., image processing circuitry) may execute the method 270 to adjust the image data provided to the display 18. The controller 82 loads (block 272) temperature data from the temperature sensors 86 of the display 18. As discussed above, the temperature sensors 86 may be arranged at the corners 88 of the display 18, corresponding to corners of the image frame. In some embodiments, the temperature data may be loaded from the temperature sensors 86 upon startup of the display. Additionally, or in the alternative, the temperature data may be loaded periodically during operation of the display. The period at which the temperature data is loaded may be once per frame of input signals, once per second, once per ten seconds, once per minute, once per hour, and so forth. Accordingly, frequent sampling of the temperature data enables the method 270 to dynamically adjust the gain to the input signals for subpixels 60 based on dynamic temperatures of the display 18.

The controller 82 may determine (block 274) the dynamic gain adjustments for the input signals corresponding to the pixels 61 of the image frame nearest the temperature sensors 86. In some embodiments, the controller 82 may determine (block 254) the dynamic gain adjustments for the input signals of each subpixel 60 (e.g., (e.g., red subpixel 60R, green subpixel 60G, blue subpixel 60B) of the image frame nearest the temperature sensors 86. Where the display 18 has temperature sensors 86 at the corners 88, the controller 82 may determine (block 274) the dynamic gain adjustments for pixels 61 of the image frame at the corners 88. In some embodiments, the controller 82 determines (block 274) the dynamic gain adjustments to the input signals corresponding to the temperature sensors 86 utilizing a dynamic gain LUT. The dynamic gain LUT is based at least in part on the thermal effects on the gain of light from the subpixels 60. In some embodiments, the controller 82 may utilize the dynamic gain LUT with interpolation (e.g., linear interpolation) to determine the dynamic gain adjustment corresponding to a temperature that is not explicitly within the dynamic gain LUT. The data of the dynamic gain LUT may be determined in advance of operation of the display 18 and stored within the local memory 14 and/or main memory storage 16 of the electronic device 10. As may be appreciated, the controller 82 may determine the dynamic gain adjustments to the input signals corresponding to the corners 88 of the image frame utilizing the dynamic gain LUT faster than via computation of the gain adjustments via a computation with the loaded temperature data.

Upon determination of the dynamic gain adjustments corresponding to the temperature sensors 86, the controller 82 may indirectly determine (block 276) the dynamic gain adjustments to input signals for points (e.g., pixels 61, subpixels 60) of the image frame to be produced on display 18. For example, the controller 82 may utilize the dynamic gain adjustments to the input signals at points corresponding to the corners 88 of the image frame with bilinear interpolation and the equation described above with FIG. 11 to indirectly determine the dynamic gain adjustments to the input signals at each point of the image frame. The controller 82 may resolve (block 264) the dynamic gain adjustment with the uniformity gain adjustment, if any uniformity gain adjustment is determined In some embodiments, the dynamic gain adjustment to the input signal for each pixel 61 and/or subpixel 60 of the image frame to be produced on the display 18 may be stored in memory until the total gain adjustment for the image frame is determined utilizing the dynamic gain adjustment and the uniformity gain adjustment. As discussed above with FIG. 10, the controller 82 may resolve (block 118 and block 264) the gain adjustments by multiplying the uniformity and dynamic gain adjustments to the input pixels, then multiplying the product by the linear space pixel input from the DeGamma.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display comprising a plurality of pixels, wherein each pixel comprises a plurality of subpixels; and a controller coupled to the display, wherein the controller is configured to control a gain of each subpixel based on multiplication of a linear space pixel input for the respective subpixel with a respective product of a dynamic adjustment for the respective subpixel and a uniformity adjustment for the respective subpixel, wherein the dynamic adjustment is based at least in part on a determined temperature or a determined brightness of the respective subpixel, and the uniformity adjustment is based at least in part on a location of the respective subpixel within the display.

2. The electronic device of claim 1, wherein the display comprises a plurality of temperature sensors disposed about the display, the plurality of subpixels comprises a set of subpixels, and the determined temperature of each subpixel of the set of subpixels is based on temperature feedback from a corresponding temperature sensor of the plurality of temperature sensors that is disposed near the location of the respective subpixel of the set of subpixels within the display.

3. The electronic device of claim 1, wherein the display comprises a liquid crystal display.

4. The electronic device of claim 1, wherein the plurality of subpixels comprises a plurality of organic light emitting diodes.

5. The electronic device of claim 1, wherein the controller is configured to determine the uniformity adjustment for the respective subpixel based at least in part on interpolation utilizing a first array of image frame grid points corresponding to a second array of coordinates across the display, wherein the second array of coordinates comprises non-uniform spacing between the coordinates across the display.

6. The electronic device of claim 5, wherein the non-uniform spacing increases from a first edge of the display to an opposite second edge of the display.

7. The electronic device of claim 5, wherein the second array comprises a denser arrangement of coordinates in corners of the display.

8. The electronic device of claim 1, wherein the controller is configured to determine gain adjustments for four or more pixels of the plurality of pixels and the respective subpixels of the display via a lookup table, and the controller is configured to determine at least one of the dynamic adjustment and the uniformity adjustment for a remainder of the plurality of pixels and the respective subpixels of the display via bilinear interpolation with the gain adjustments for the four or more pixels and the respective subpixels.

9. A device, comprising:

a display comprising a first plurality of pixels, a second plurality of pixels, and a third plurality of pixels; and image processing circuitry coupled to the display, the image processing circuitry comprising a controller, wherein the controller is configured to:

control input signals to the first plurality of pixels, the second plurality of pixels, and the third plurality of pixels, wherein each pixel of the first plurality of pixels, the second plurality of pixels, and the third plurality of pixels comprises a plurality of subpixels;

control a gain of each subpixel of the first plurality of pixels, the second plurality of pixels, and the third plurality of pixels based on multiplication of a linear space pixel input for the respective subpixel with a product of a uniformity adjustment to the input signal for the respective subpixel and a dynamic adjustment to the input signal for the respective subpixel;

determine the uniformity adjustment to the input signals for the subpixels of the first plurality of pixels based at least in part on first locations of each pixel of the first plurality of pixels on the display and a lookup table that corresponds to grid points of a grid across the display, wherein the grid comprises a non-uniform spacing between grid points, each grid point corresponds to the respective first location of a respective pixel of the first plurality of pixels, sets of grid points identify corners of a plurality of regions across the display, and the second plurality of pixels is non-uniformly distributed among the plurality of regions, wherein at least two of the plurality of regions contain different numbers of the second plurality of pixels;

determine the uniformity adjustment to the input signals for the subpixels of the second plurality of pixels based at least in part on second locations of the second plurality of pixels on the display within a respective region of the plurality of regions and interpolation with the uniformity adjustments to the input signals for the subpixels of the first plurality of pixels that identify the respective region of the plurality of regions; and determine the dynamic adjustment for each subpixel of the first plurality of pixels, the second plurality of pixels, and the third plurality of pixels based at least in part on a determined temperature for each subpixel.

10. The device of claim 9, wherein the non-uniform spacing increases from a first edge of the display to an opposite second edge of the display, and first regions of the plurality of regions nearer the first edge of the display comprise fewer pixels of the second plurality of pixels than second regions of the plurality of regions nearer the opposite second edge of the display.

11. The device of claim 9, wherein the controller is configured to:

wherein the dynamic adjustment for each subpixel is based at least in part on the first locations, the second locations, and interpolation with dynamic temperature adjustments to the input signals for the subpixels of the third plurality of pixels.

12. A method, comprising:

determining, with data processing circuitry, grid point gain adjustments for a plurality of grid points corresponding to coordinates across a display;

determining, with the data processing circuitry, uniformity gain adjustments for a plurality of pixels across the display via interpolation with the grid point gain adjustments, wherein the plurality of pixels are arranged in a pixel array with a uniform distribution across the display;

determining dynamic gain adjustments for the plurality of pixels based on respective temperatures of each pixel of the plurality of pixels;

multiplying, with the data processing circuitry, the uniformity gain adjustment for each pixel of the plurality of pixels by the dynamic gain adjustment for the respective pixel of the plurality of pixels to obtain a product gain adjustment for the respective pixel; and multiplying the product gain adjustment for the respective pixel with a linear space input signal to the respective pixel, wherein a drive strength supplied to the respective pixel is based at least in part on the linear space input signal, and the drive strength supplied to each pixel is configured to control light emitted from the respective pixel.

13. The method of claim 12, wherein the interpolation comprises bilinear interpolation.

14. The method of claim 12, comprising:

converting a non-linear space input signal to each pixel of the plurality of pixels to the linear space input signal prior to determining the uniformity gain adjustments for the plurality of pixels; and converting the linear space input signal to each pixel of the plurality of pixels to the non-linear space input signal after multiplying the product gain adjustment for each pixel of the plurality of pixels by the linear space input signal to the respective pixel.

15. The method of claim 12, wherein determining dynamic gain adjustments for the plurality of pixels comprises:

determining first dynamic gain adjustments for a set of pixels of the plurality of pixels based on respective temperatures of each pixel of the set of pixels;

determining second dynamic gain adjustments for a remainder of pixels of the plurality of pixels based on interpolation with the first dynamic gain adjustments for the set of pixels, wherein the remainder of pixels comprises the plurality of pixels less the set of pixels; and wherein the dynamic gain adjustments for the plurality of pixels comprise the first dynamic gain adjustments for the set of pixels and the second dynamic adjustments for the remainder of pixels.

16. The method of claim 12, wherein each pixel of the plurality of pixels comprises a first subpixel and a second subpixel, wherein determining uniformity gain adjustments for the plurality of pixels comprises determining a first subpixel uniformity gain adjustment for the first subpixel and determining a second subpixel uniformity gain adjustment for the second subpixel, wherein the first subpixel uniformity gain adjustment is different than the second subpixel uniformity gain adjustment.

17. The method of claim 12, wherein each pixel of the plurality of pixels comprises a plurality of organic light emitting diodes.

18. The method of claim 12, wherein the drive strength supplied to each pixel of the plurality of pixels is configured to align light emitted from the respective pixel to a target white point for the display.

19. The method of claim 12, wherein the coordinates comprise a non-uniform spacing across the display, and the coordinates nearer to a first edge of the display are more dense than coordinates in an interior of the display.

* * * * *